US006793106B1

(12) United States Patent
Kerry

(10) Patent No.: US 6,793,106 B1
(45) Date of Patent: Sep. 21, 2004

(54) BOW-STERN CANOE BOX

(76) Inventor: Parker Kerry, 6 Mill La., Belfast, ME (US) 04915

( * ) Notice: Subject to any disclaimer, the term of this patent is extended or adjusted under 35 U.S.C. 154(b) by 113 days.

(21) Appl. No.: 10/215,853

(22) Filed: Aug. 9, 2002

Related U.S. Application Data

(60) Provisional application No. 60/391,394, filed on Jun. 25, 2002.

(51) Int. Cl.[7] ..... B63B 17/00

(52) U.S. Cl. ..... 224/153; 114/347; 114/364; 224/406; 224/539; 224/543

(58) Field of Search ..... 224/153, 406, 224/539, 540, 542, 543, 544, 572; 114/343, 347, 363, 364

(56) References Cited

U.S. PATENT DOCUMENTS

| | | | | | |
|---|---|---|---|---|---|
| 906,261 | A | * | 12/1908 | Morzinski | 114/355 |
| 1,172,974 | A | * | 2/1916 | Frayser | 114/347 |
| 3,958,289 | A | | 5/1976 | Carlson | |
| 4,398,488 | A | | 8/1983 | Mathieu | |
| 4,488,623 | A | | 12/1984 | Linnell, II et al. | |
| 4,503,799 | A | * | 3/1985 | Masters | 114/363 |
| 4,593,642 | A | | 6/1986 | Shay | |
| D294,659 | S | | 3/1988 | Hanna et al. | |
| 4,827,864 | A | * | 5/1989 | LaMontagne et al. | 114/343 |
| 5,662,061 | A | | 9/1997 | Salathe | |
| 5,673,646 | A | * | 10/1997 | Knudson | 224/406 |
| 6,035,800 | A | * | 3/2000 | Clifford | 114/347 |
| 6,223,677 | B1 | * | 5/2001 | Hall et al. | 114/364 |
| 6,354,238 | B1 | * | 3/2002 | Molesworth et al. | 114/343 |

* cited by examiner

*Primary Examiner*—Gary E. Elkins
(74) *Attorney, Agent, or Firm*—Thomas L. Bohan; Patricia M. Mathers

(57) ABSTRACT

A removable, storage box for use within a canoe or other small boat. The shape of the box is such that it fits securely within the tapered bow or stem of a canoe or any watercraft having adequately shaped bow and/or stern regions, without degrading the watercraft's stability or seaworthiness. The key to the utility of the box is that because of its overall shaped it can be wedged in between the watercraft's floor and the underside of its gunwale flanges. Once the box is so situated, its wedged fit holds it in place both for water travel; during portaging, it can be removed for carrying on one's back or it can be left in place to be carried along with the canoe. Also, because of the wedge fit, the lid of the box is held firmly closed during travel by the gunwale flanges. Because of the thermal insulation of the box, this tight closure of the lid allows either hot or cold items to be transported without their undergoing undesired temperature chages.

10 Claims, 2 Drawing Sheets

BOW-STERN CANOE BOX

BACKGROUND OF THE INVENTION

1.Field of Invention

The invention relates to the field of small boats. More particularly, it relates to canoes or other open-hulled boats that have a pointed bow, pointed stern, or both. More particularly still, the invention relates to storage compartments that can be installed on said boats.

2. Description of Prior Art

In the field of canoeing, there is an ancient and well-known device, the "wanigan," for carrying items in a secure fashion within the vessel while it is underway. A wanigan typically is a wooden box having a rectangular cross-section and a hinged or removable lid and, sometimes, equipped with carrying handles on the sides. The wanigan is filled with items that are to be taken along on the voyage, and then it is placed within the canoe, typically in a manner permitting its bottom to rests directly on the floor of the canoe.

A number of patents have issued for canoe storage compartments that are essentially modifications of the traditional wanigan design. Linnell, II et al. (U.S. Pat. No. 4,488,623) describes a travel box for a canoe that differs very little from the traditional wanigan design aside from the addition of a storable panel that may be attached to the edge of the box and used as a table. Linnell, II et al. lacks any means of securing the box immovably to the canoe. The securing means taught be Linnell, II et al. consist of flexible loop handles attached to the box and deployed by passing them around the canoe thwarts or struts would not prevent the box from shifting while the canoe is underway, a potentially serious hazard. Also, the box of Linnell, II et al. appears not to make efficient use of the space within the canoe, its exterior shape not conforming sufficiently with the inner shape of the hull. In fact, the shape of the box taught by Linnell, II et al. requires that the box be placed in the middle portion of the canoe ("amidships") where passengers typically sit, thus interfering with the full use of the canoe. Finally, the box disclosed by Linnell, II et al. extends above the canoe's gunwales, a circumstance that not only raises the center of mass of the canoe+load (with the concomitant degrading of stability), but also can interfere with the paddling.

Mathleu (U.S. Pat. No. 4,398,488) describes an insulated cooler box intended for use within a canoe and which avoids some of the problems set out above. The box taught by Mathleu is tapered longitudinally, narrowing toward the rear (the end intended to be proximal to one end or the other of the canoe), and is equipped with a metal channel along each of the upper, outside edges. This configuration allows the box to be mounted on and suspended from the flanges extending inboard from the two gunwales, and then slid toward an end of the canoe, such that its tapered shape fits snugly against the inside of the hull so as to hold It securely in place. While the box of Mathleu does permit the container to be rigidly mounted within the canoe, its shape does not appear to be directed toward fitting it into either the extreme fore or aft of the vessel, the most unused spaces In a canoe. Furthermore, by its nature, it mounts in the canoe in such a way that its metal channels rest atop the gunwales, again creating the potential for Interference with the paddle. Furthermore, the above-the-gunwales mount means that the center-of-mass height of the canoe/box combination is not minimized.

Shay (U.S. Pat. No. 4,593,642) describes a carrying case that can be mounted within a canoe. The case described by Shay is designed to fit over the center thwart of the canoe, and is held in place by several mechanical latches fastened to the flange of the canoe. This case described by Shay is designed so that the upper portion of the case extends several inches above the gunwales of the canoe. The complexity of the mechanism for securing this invention limits the convenience of its use. In addition, its position astride one of the canoe's thwarts is undesirable because of center-of-mass height considerations.

Carlson (U.S. Pat. No. 3,958,289) describes a storage compartment intended for mounting within a canoe. In use, the compartment described by Carlson sits crosswise in the center of the canoe, being held in place by screw clamps affixing it to the gunwales. The compartment of Carlson has the disadvantage of not being easily mounted or removed from the canoe. In addition, its shape prevents it from making efficient use of space and causing it to sit high within the canoe, to the detriment of center of mass height.

A more recently disclosed storage compartment intended for use within a canoe is taught by Salathe (U.S. Pat. No. 5,662,061). It is shaped to fit within a canoe, thus improving the use of space, but is intended to be held in place simply by gravity. Skid pads affixed to the bottom of the Salathe box to reduce the likelihood of its sliding along the bottom of the canoe. In addition to being shaped to conform more with hull shape, the Salathe box is presented as doubling as a seat for a canoeist. While it may play such a role In those canoes that do not feature integral seats, it will be rather awkward to use in the majority of canoes that already have a seat for the canoeist. Use of the Salathe box in a canoe already equipped with one or more seats would require either the removal of one of those seats, or the Installation of the box in a location away from the seats. Furthermore, there is a question of whether, even in a canoe where the Salathe box can serve as a seat, the box is so high that it will raise the center of mass of the canoeist above what it would otherwise be.

A wanigan design described by Hanna et al. (U.S. Pat. No. D294, 659) discloses novel ornamental elements for a container intended for use within a canoe, but does not suggest functional features of such a container and hence does not offer solutions to the problems noted above in the utilitarian prior art.

Therefore, what is needed is a canoe box with which to convey securely and without water damage all of the items that a canoeist might wish to transport. What is further needed is such a box that is easy to affix to and to remove from a canoe and that, once affixed will not shift with the motion of the canoe. What is yet further needed is such a box that makes efficient use of the space within a canoe without constraining the canoe hull from flexing, and does not interfere with the comfort of canoe passengers or the efficiency of the paddling of the canoe. Finally, what is needed is such a box that once affixed to a canoe will remain affixed should the canoe capsize and will serve as additional flotation for a capsized or swamped canoe.

SUMMARY OF THE INVENTION

It is an object of the present invention to provide a storage container (alternately referred to herein as a box) that is readily affixable to and removable from the regions of a watercraft that contain the space that is least valuable to the users of the watercraft. It is a further object to provide such a container that when affixed in those regions it does not interfere the occupants of the watercraft, nor, when the watercraft is a canoe, with the paddling nor the seaworthiness of the canoe. (Although for definiteness, the watercraft will be referred to as a canoe from this point forward, it is to be understood that the present invention has equal applicability to any boat presenting a bow or stern configuration generally similar to that of a canoe.) It is a yet further object that the canoe box of this invention does not raise the center of mass of the canoe plus contents once it is in place.

These objects are met by producing a box that it will fit snugly into either the bow or stem of the canoe for which it is intended, something that to first order requires that the box be tapered from front to rear in conformance with the shape of the canoe hull near its extremities. Although there are some variations in this shape when one looks at the entire universe of canoes, one canoe feature that is constant across most of that universe is the presence of gunwale flanges (alternately denotable as lips, ridges, or rims) that extend inboard from the outer gunwale edges. The box of the present invention makes use of those flanges and the typical shape of the bow of a canoe, being itself shaped so that it can be reversibly inserted into a tight fit in the bow.

The basic idea underlying the invention can be seen from a description of how it is secured in place in the bow of a canoe. First, it lowered to the bottom of the boat as close to the bow as can be done without the gunwale ridges getting in the way of the lowering, with the narrow end of the box (the "rear") facing the bow. If the items to be transported have not already been placed inside the container, the top of the container, which in the Preferred Embodiment is a lid hingedly attached to the top of the container's wide end, is lifted and the items to be carried placed inside. The lid is then lowered and the box pushed forward along the canoe bottom as far as it will go. As the box moves forward, the shape of the canoe bottom causes it to rise upward, so that as its narrow end (rear) nears the very front of the canoe, its lid begins to press against the undersides of the gunwale flanges. When this happens, the forward movement of the box is brought to a halt, the box having become wedged between the flanges and the bottom of the canoe. Because of the shape of the canoe hull, the contact between the box and the bottom of the canoe is limited to the outer edges of the bottom of the box (its base). This is important, since this minimal contact leaves the major part bulk of the hull free to flex in response to forces imposed on the canoe by its environment while underway under various water conditions, as the canoe is designed to do.

Some embodiments of the invention include a box-securing strap affixed to the narrow end of the box with the free end of this strap available to be looped through a lifting handle such as those located in the bow and stem of most canoes. This provides extra security against movement of the box, in addition to that provided by the friction fit of the box between the bottom of the hull and the gunwales. That is, it is added security against the box sliding out of the bow under the stresses of rough water conditions or longitudinal forces exerted on the box while it is being portaged while still affixed in the bow. As another backup security measure in some embodiments one or more lid-securing straps are affixed to the narrow end of the box, with provision made to buckle these one or more straps onto the lid itself. By this method, the lid can be held tightly shut even if the gunwale flanges are not holding it down. Some type of lid-securing approach is a practical necessity for carrying the container separately from the canoe during portages; however, it may not be necessary while the container is fixed in place in the canoe, the manner In which the container is secured into the canoe effectively holding the lid tightly closed. Indeed, in those embodiments provided with thermal insulation on the Inside of the container and a sealing gasket around the perimeter of the lid, the container provides a water-tight, thermally insulated environment for its contents, once it is secured in the canoe. These watertight embodiments also provide the advantage of added buoyancy ("flotation"), helpful in the event of capsizing or swamping of the canoe.

In its Preferred Embodiment, the canoe box also has shoulder straps to facilitate its being carried on the back by one of the canoeists during portages. Alternatively, and most useful If a person is canoeing alone, the box can be left secured in the canoe during portages, eliminating its removal and re-insertion and possibly eliminating the need for a second trip by the canoeist along the portage path. Finally, it is noted that for those circumstances where a larger load must be carried in the canoe than can be accommodated in a single one of these boxes, the canoeist can use two of them, one affixed in the bow and the other in the stern, the method of affixing in the stem being identical to that used for the bow.

DETAILED DESCRIPTION OF THE PREFERRED EMBODIMENT

Figure 3:
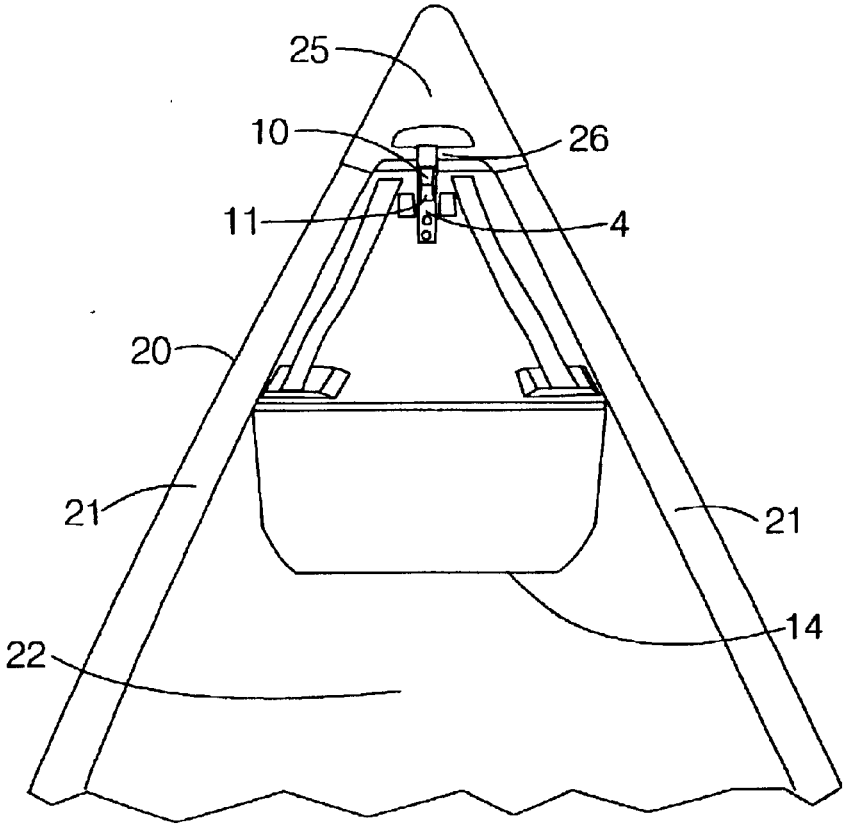
FIG. 3 is a perspective view of the Preferred Embodiment affixed in the bow of a canoe, viewed from above.
Figure 4:
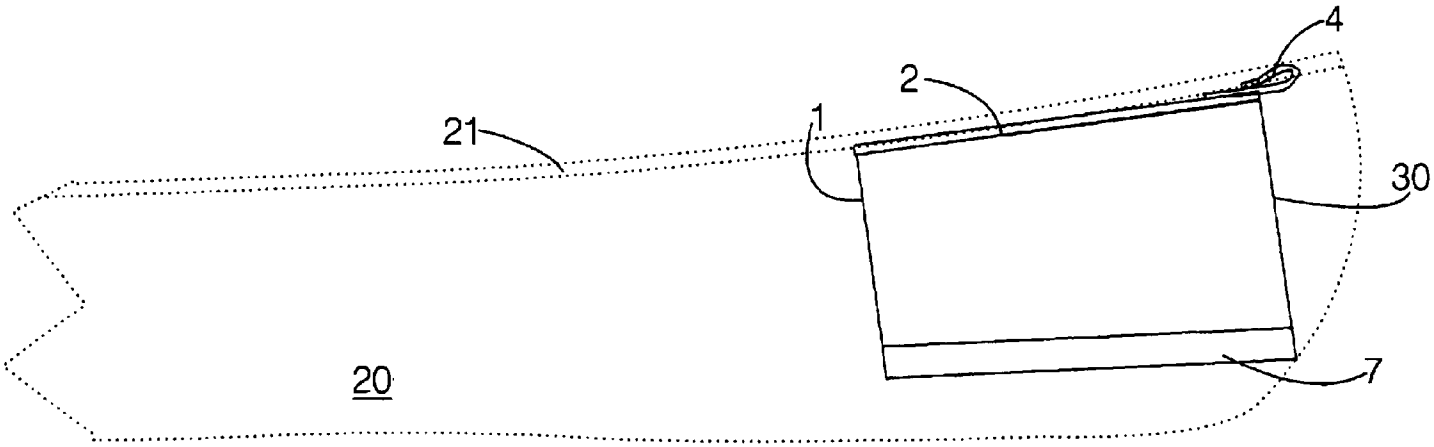
FIG. 4 is a partial cutaway view of the Preferred Embodiment affixed in the bow, shown at approximately the transverse midpoint of the box.
Figure 5:
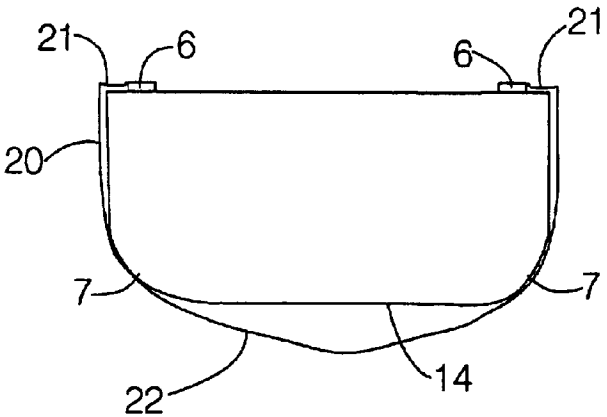
FIG. 5 is a front cutaway view of the Preferred Embodiment affixed in the bow, made at about the longitudinal midpoint of the box.

FIG. 3, FIG. 4, and FIG. 5 show that the Preferred Embodiment of the present invention is a box 100 intended to be secured to a canoe 20.

Figure 1:
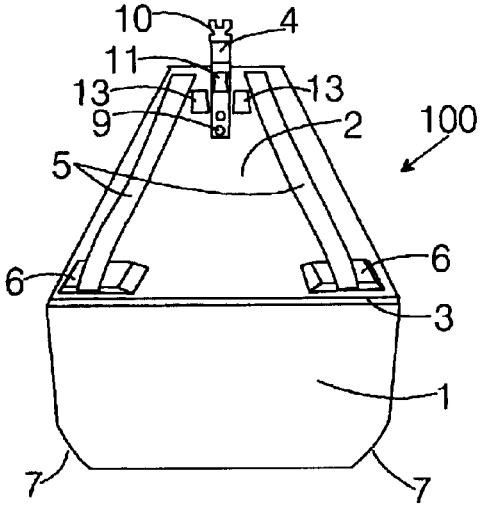
FIG. 1 is a perspective view of the Preferred Embodiment of the present invention, with its front end and top shown.
Figure 2:
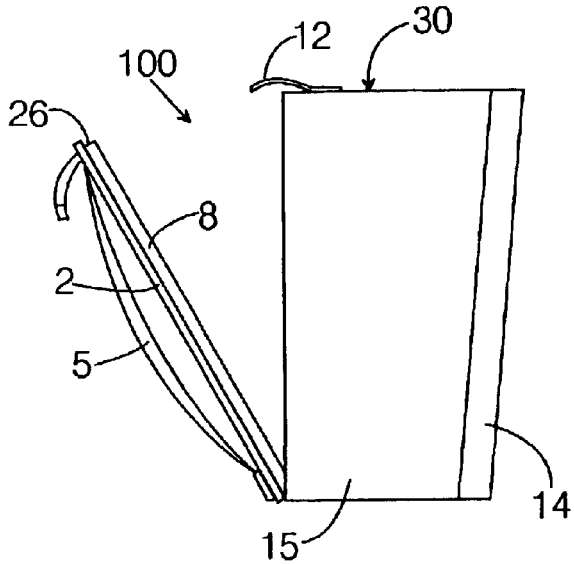
FIG. 2 is a side view the Preferred Embodiment resting on its front end with its lid partially open.

Referring to FIG. 1, FIG. 2 and FIG. 5, it can be seen that the box 100 includes a front 1, a rear 30, a base 14, and a lid 2, the lid 2 being hingedly affixed to the front 1 by a hinge 3, and a box-securing strap 4 is permanently attached to the lid 2 by means of rivets 9. Also attached to the lid 2 are two shoulder-strap mounts 6, two shoulder straps 5, and a pair of lid-securing-buckles 13. A pair of lid-securing straps 12 are permanently attached off-centeredly to the rear 30, their free ends adapted to fit into the lid-securing buckles 13. Note that the shoulder strap mounts 6 are positioned inboard from the edge of the lid 2, a feature that plays a role in the affixing of the box 100 in a canoe.

The vertical cross-section of the box 100 is indicated by the shape of the front 1, the lower end of which has two rounded shoulders 7. These rounded shoulder 7 extend the length of the base 14, that is, the length of the box 100. The shape of the rounded shoulders 7 is chosen so that when the box 100 is resting on a canoe bottom 22, the base 14 will conform closely to the rounded shape of the canoe bottom 22. It is the rounded shoulders 7, and no other part of the box 100 that contacts the inside of the hull. The horizontal cross-section of the box 100 is indicated by the shape of the lid 2, which is seen in FIG. 1 to grow narrower as one progresses from the front 1 to the rear 30. This tapering is provided so as to enable the box 100 to fit securely within a bow 25 or stern (not shown) of the canoe 20. For the same reason, and as can be seen most dearly in FIG. 2, the depth of the box 100 increases slightly as one progresses from the front 1 to the rear 30, the rear 30 being taller than the front 1. Both the height and width tapers are selected to make the box 100 conform with the inside shape of the bow 25 in the canoe 20 for which the box 100 is intended, all as depicted in part In FIG. 3 and FIG. 4.

FIG. 3 depicts the box 100 when it is inserted into the bow 25 of the canoe 20, being pressed against the canoe bottom 22 by gunwale flanges 21 that extending along the upper edges of the hull.

Returning to FIG. 2, the lid 2 can be observed in a partially opened configuration, pivoted about the hinge 3. The surface of the lid 2 that faces the Interior of the box 100 is lined with Insulating material 8, as are the inner surfaces of the rest of the box 100, thus permitting the box 100 to be used for the transportation of refrigerated or heated items with minimal temperature change. Around the perimeter of the inner surface of the lid 2 is a sealing gasket 26 disposed thereon for the purpose of providing an air-tight seal when the lid 2 is pressed against the rest of the box 100.

When the box 100 is securely closed by use of the lid-securing straps 12, but not affixed to the canoe 20, the shoulder straps 5 can be used to mount the box 100 on a person's back for transportation over land. The shoulder straps 5 are adjustable both to accommodate different sized canoeists and also to allow them to be cinched in and thus out of the way when the box 100 is affixed to the canoe 20.

The bow 25 of the canoe 20 with which the Preferred Embodiment is intended to be used is equipped with a lifting handle 26 integral to the canoe 20. The lifting handle 26 enables the backsliding-prevention backup means to be used. That is, with the box 100 affixed in the bow 25, the box-securing strap 4 is passed through the lifting handle 26 and, as shown in FIG. 1 and FIG. 3, a buckle tongue 10 on the free end of the box-securing strap 4 is inserted into a corresponding buckle clasp 11 mounted at the approximate midpoint of the securing strap 4.

In Summary, the Preferred Embodiment box 100 is installed in the canoe 20 as follows. First it is lowered onto the canoe bottom 22 a few iches aft of what is to be its final position, the rear 30 facing the bow 25 and the outside surface of the lid 2 facing upward. At this point the base 14 of the box 100 is supported by the canoe bottom 22, with the rounded shoulders 7 of the base 14 contacting the canoe bottom 22 at its outer edges, where the hull begins to curve upward in the transition between the canoe bottom 22 and the canoe sides, as can be seen in FIG. 5. The box 100 is then slid forward toward the bow 25. As it moves, the rounded shoulders 7, and hence the box 100 itself will be forced upward due to the changing shape of the hull as one moves toward the bow 25. As a consequence, the outer edges of the lid 2 come into contact with, and then press against, the undersides of the gunwale flanges 21, as shown in FIG. 4 and FIG. 5.

Once the box 100 cannot be moved forward any further, the free end of the securing strap 4 is looped under and over the lifting handle 26, the buckle tongue 10 fitted into the buckle clasp 11, and the free end of the securing strap 4 pulled taut. With the box 100 thus secured within the canoe 20, it cannot come free, regardless of the motion or flexing of the canoe 20. This includes the complete removal of the canoe 20 from the water and its inversion onto the shoulders of a canoeist for portaging. Furthermore, it is impossible for the lid 2 to come open when the box 100 is properly mounted within the canoe 20 because it is being held down onto the box 100 by the presence of the gunwale flanges 21 pressing down on it. Note in this regard that the shoulder strap mounts 6 are not in contact with the gunwales with the box 100 in its final secured position, as can be seen in FIG. 3 and FIG. 5.

FIG. 4 and FIG. 5 present two views of the Preferred Embodiment affixed in the bow 25, showing in particular how the upper surface of the lid 2 presses up against the gunwale flanges 21 and the rounded shoulders 7 at the bottom of the container press against the corresponding rounded outer edges of the lower portion of the hull. The securing strap 4 is shown affixed to the lifting handle 26, as discussed above.

The detailed of the Preferred Embodiment of the present invention have been set out above to more fully teach the elements of the invention. It is not intended thereby to indicate that the claimed invention is narrower than the description provided in the Summary and the Claims. Persons knowledgeable in the art of boating and boat design will readily be able to produce variations of the design given herein, variations that will nevertheless fall within the ambit of the present invention.

I claim:

1. A storage box for transporting goods within a watercraft having a bow, a stern, gunwale flanges, and an inner hull bottom, said box comprising:

six sides including a front, a rear, a base, a lid, a first sidewall, and a second sidewall, wherein said lid, said bottom, said front, said first sidewall, and said second sidewall are combined so as to form a six-sided enclosure having a shape that fits removably into said bow such that once said box is firmly in place, said base rests on and presses against said hull bottom and said lid presses up against said gunwale flanges.

2. The box of claim 1 wherein said watercraft is a canoe.

3. The box of claim 2 further comprising a securing strap attached to said box whereby said container may be secured to said bow.

4. The box of claim 3 wherein each of said six sides is covered on an inner surface with thermal insulating material.

5. The box of claim 4 wherein said lid is affixed to a top of said front by a hinge, said lid being free to pivot about said hinge so as to permit said box to be opened and closed, respectively.

6. The box of claim 5 wherein mounted on an outer surface of said lid are two adjustable shoulder straps configured to allow said box to be carried on a person's back when said box is separated from said canoe.

7. The box of claim 6 wherein each of said shoulder straps is affixed to said lid by means of a shoulder strap mount.

8. The box of claim 7 wherein each said shoulder strap mount is located just far enough inboard on said lid so as not to come into contact with one of said gunwale flange when said box is affixed in said bow.

9. The box of claim 8 also including a lid-securing strap with a first end of said strap fixed connected to said lid and a second end available to be removably affixed to said rear in such manner to firmly hold said lid down and said container closed.

10. A storage container for watertight and thermally insulated transportation of items in a canoe having a bow, a stern, gunwale flanges, a hull bottom, and a bow lift handle, said container comprising:

an inner surface, and outer surface, six interconnected sides, wherein said six interconnected sides define said inner surface and said outer surface and said six interconnected sides include a base, a lid, a rear, a front, and two sidewalls, wherein said inner surface is covered with thermal insulation, all of said six interconnected sides apart from said lid are connected to one another at joints that are substantially airtight, wherein said lid is attached to a top of said front by a hinge about which said lid is free to pivot, wherein a gasket is attached to an inner surface of said lid so that when said lid is positioned so as to close said container, said gasket creates a substantially airtight seal around a perimeter of said lid, and wherein said outer surface has a shape that conforms with that of said canoe at said bow so that said container can be tightly inserted into said bow with said rear in close proximity to said bow, said lid is tightly pressed by said gunwale flanges, said base is in contact with said hull bottom.

* * * * *

UNITED STATES PATENT AND TRADEMARK OFFICE

CERTIFICATE OF CORRECTION

PATENT NO. : 6,793,106 B1
DATED : September 21, 2004
INVENTOR(S) : Kerry Parker

It is certified that error appears in the above-identified patent and that said Letters Patent is hereby corrected as shown below:

Title page,
Item [12], "Kerry" should be -- Parker --.
Item [76], Inventors, "Parker Kerry" should be -- Kerry Parker --.

Column 1,
Lines 45-65, any reference to "Mathleu" should be -- Mathieu --.

Column 3, line 1, through Column 4, line 19,
Any reference to "stem" should be -- stern --.

Signed and Sealed this

Nineteenth Day of April, 2005

JON W. DUDAS
*Director of the United States Patent and Trademark Office*